US006319057B2

(12) United States Patent
Sekido et al.

(10) Patent No.: US 6,319,057 B2
(45) Date of Patent: Nov. 20, 2001

(54) ELECTRICAL CONNECTOR HOUSING

(75) Inventors: Toshihisa Sekido; Takahiro Asao, both of Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/726,343

(22) Filed: Dec. 1, 2000

(30) Foreign Application Priority Data

Dec. 2, 1999 (JP) ..... 11-343643

(51) Int. Cl.[7] ..... H01R 13/52

(52) U.S. Cl. ..... 439/519; 439/76.1; 439/205; 439/190

(58) Field of Search ..... 439/519, 76.1, 439/76.2, 205, 206, 190

(56) References Cited

U.S. PATENT DOCUMENTS 4,909,745 * 3/1990 Hayashi ..... 439/76
5,769,648 * 6/1998 Hayashi ..... 439/206
5,876,243 * 3/1999 Sangawa ..... 439/159
6,200,169 * 3/2001 Tseng ..... 439/699.1

FOREIGN PATENT DOCUMENTS 7309047 2/1995 (JP) .

* cited by examiner

*Primary Examiner*—Gary Paumen
*Assistant Examiner*—Truc Nguyen
(74) *Attorney, Agent, or Firm*—Greenblum & Bernstein, P.L.C.

(57) ABSTRACT

An electrical connector housing includes a lower shell, a connector block and an upper shell. An upper panel of the lower shell includes a first fixing mount and a draw hole, and the upper shell includes an outer side face having a second fixing mount. The upper panel of the lower shell has an inner face including a rib which is placed near the draw hole and extends towards the side panel of the lower shell while surrounding the draw hole. Likewise, the upper face of the connector block includes a pair of partition walls at a position corresponding to that of the rib, so that, when the connector block is inserted into the lower shell, the partition walls are closely superposed on the rib, and a draining space is formed away from a space for fixture ports for electrical parts, and leads to the drain hole. Such a configuration prevents the electrical connector housing from becoming too large and too costly. Such a housing structure also provides a better waterproofing quality.

12 Claims, 7 Drawing Sheets

ELECTRICAL CONNECTOR HOUSING

BACKGROUND OF THE INVENTION

1. Field of the Invention

The present invention relates to an electrical connector housing mounted in an engine compartment of e.g. automobiles. More specifically, the invention concerns an electrical connector housing suitably protected from water penetration.

2. Description of Background Information

FIGS. 1 and 2 show the structure of a known electrical connector housing mounted in a car's engine compartment.

As shown in FIG. 1, such an electrical connector housing 51 comprises a hollow lower shell 52, inside of which is fixed an electrical-parts fitting block 53. An upper shell 54 is then placed over the open side of the lower shell 52.

The upper surface of the electrical-parts fitting block 53 is provided with a plurality of equipment-fixing ports 53*a*. As shown by long and short dotted lines in FIG. 2, these ports are mounted with various electrical parts 57 such as relays and fusible links.

The lower shell 52 has a first fixing mount 55, which extends outwardly from the outer side face 52*a* of the lower shell 52 and freely engages with, or disengages from, the upper shell 54. The first fixing mount 55 has a first hook 55*a*, the edge of which projects towards the outer side face 52*a* of the lower shell 52. Likewise, the upper shell 54 has a second fixing mount 56 which extends outwardly from the outer side face of the upper shell 54 at a position corresponding to that of the first fixing mount 55, and engages therewith. The second fixing mount has a second hook 56*a* which projects outwardly, whereby the first and second hooks 55*a* and 56*a* are locked, when the upper shell 54 is superposed on the lower shell 52.

The electric parts block 53 is thus contained in, and protected by, the lower shell 52. Further, the opening of the lower shell 52 is closed and protected by the upper shell 54. In such a structure, the electrical-parts fitting block can be efficiently protected from water penetration or water spray.

However, such an electrical connector housing 51 carries first and second fixing mounts 55 and 56 at the outer side faces 52*a* and 54*a* of the respective lower shell 52 and upper shell 54. These fixing mounts 55 and 56 project outwardly from the lower and upper shells 52 and 54. The electrical connector housing 51 is thus made larger by a space needed for forming these fixing mounts 55 and 56. This naturally requires a larger space for installing the electrical connector housing 51 in the engine compartment.

To counter this problem, there has been proposed a second type of electrical connector housing 61, shown in FIG. 3, in which first and second fixing mounts 55 and 56 are formed on the upper face of the lower shell 52. In this construction, the fixing mounts 55 and 56 are placed on a locus of the electrical-parts fitting block 53 outside the equipment-fixing ports 53*a*. This is explained by the fact that such a locus with no equipment-fixing port 53*a* need not be protected by the upper shell 54.

Accordingly, in the second type electrical connector housing 61, the enlarged size, with respect to the first type electrical connector housing 51, is avoided by omitting the outward projection of the fixing mounts 55 and 56.

Instead, however, the second type of electrical connector housing 61 of FIG. 3 must be provided with a vertically formed draw hole 62 at a position of upper face of lower shell 52 where the first fixing mount 55 is formed. The formation of the draw hole 62 becomes necessary when the lower shell 52 is formed by a die which undergoes stamping in the direction V shown in FIG. 3. Furthermore, this draw hole 62 is indispensable when a hook 55*a* is formed on the first fixing mount 55.

However, when such a draw hole 62 is formed in the lower shell 52, the housing becomes susceptible to water penetration through the draw hole 62. The penetrating water then reaches the connecting portions between electrical parts 57 and their fixing ports 53*a*, thereby causing malfunctioning of the electrical parts.

In order to avoid water penetration, it may be contemplated to have a lower shell 52 having no draw hole 62. However, such a construction would require stamping in a direction other than direction V. The construction of dies to be used for such a stamping stroke may then become very complex, and would increase the manufacturing costs of dies and, as a result, product costs.

SUMMARY OF THE INVENTION

The present invention has been conceived under these contexts, and aims at improving the waterproof quality of an electrical connector housing, while avoiding enlarging its size and the increase of its manufacturing costs.

To this end, there is provided an electrical connector housing including a lower shell having an upper panel with at least one opening and a side panel, at least one connector block including fixture ports provided thereon and being contained in the lower shell, and at least one upper shell covering the opening(s) of the upper panel in a freely engageable and removable way. The upper panel of the lower shell includes at least one first fixing mount with a locking hook and at least one draw hole both positioned outside the opening(s), the upper shell(s) including an outer side face having at least one second fixing mount, such that the draw hole(s) can be used for forming the locking hook and such that the second fixing mount is/are freely engageable with, and removable from, the first fixing mount.

Further, the upper panel of the lower shell has an inner face including at least one rib which is placed near the draw hole(s) and extends towards the side panel of the lower shell while surrounding the draw hole(s), and the upper face of the connector block(s) include a pair of partition walls at a position corresponding to that of the rib(s) so that, when the connector block(s) is/are inserted into the lower shell, the rib(s) is/are interposed between the partition walls, thereby forming a draining space away from a space for the fixture ports.

According to another aspect of the present invention, the electrical connector housing may include a lower shell which is formed substantially in an L-shape, when viewed from the above, and includes an upper panel with two openings. The electrical connector housing then includes two separate connector blocks and two separate corresponding upper shells, and each of the two openings, two connector blocks and two upper shells include a corresponding draw hole and first and second fixing mount.

Suitably, the rib(s) further extend(s) from top to bottom on an inner face of the side panel in the lower shell, and the pair of partition walls further extends from top to bottom on the side face of the connector block.

Preferably, the upper face of the connector block has an enclosed portion between the partition walls and the enclosed portion includes a portion inclining towards the side face of the connector block.

According to another aspect of the present invention, a first fixing mount and a second fixing mount are provided on the upper face of a lower shell, so that the fixing mounts do not project outwardly from the lower face. Enlargement of the electrical connector housing is thus avoided. On the other hand, a draining space is formed between a rib formed on the lower shell and partition walls formed on the connector block, so that water penetrating via the draw hole runs down along this draining space. Further, the draining space is separated from the space formed at the side of the fixture ports for electrical parts, so that the drained water cannot enter the latter space. The electrical connector housing is thus rendered highly waterproof.

Though the lower shell includes a rib, the lower shell can be formed without using a complex die, so that the electrical connector housing can be manufactured at a low cost.

According to a further aspect of the present invention, the water penetrating into the draining space via the draw hole runs down along an inclined portion toward the outside the connector block in a swift and efficient manner. Water is thus positively prevented from entering the space at the side of the fixture ports for the electrical parts.

According still to another aspect of the present invention, water running down toward the outside of the connector block in the draining space is led out toward the low end of the connector block and lower shell via the extending rib and partition walls. Water is thus further positively prevented from entering the space at the side of the fixture ports.

BRIEF DESCRIPTION OF THE DRAWINGS

The above and the other objects, features and advantages of the present invention will be made apparent from the following description of the preferred embodiments, given as non-limiting examples, with reference to the accompanying drawings, in which.

DETAILED DESCRIPTION OF THE PREFERRED EMBODIMENTS

Figure 1:
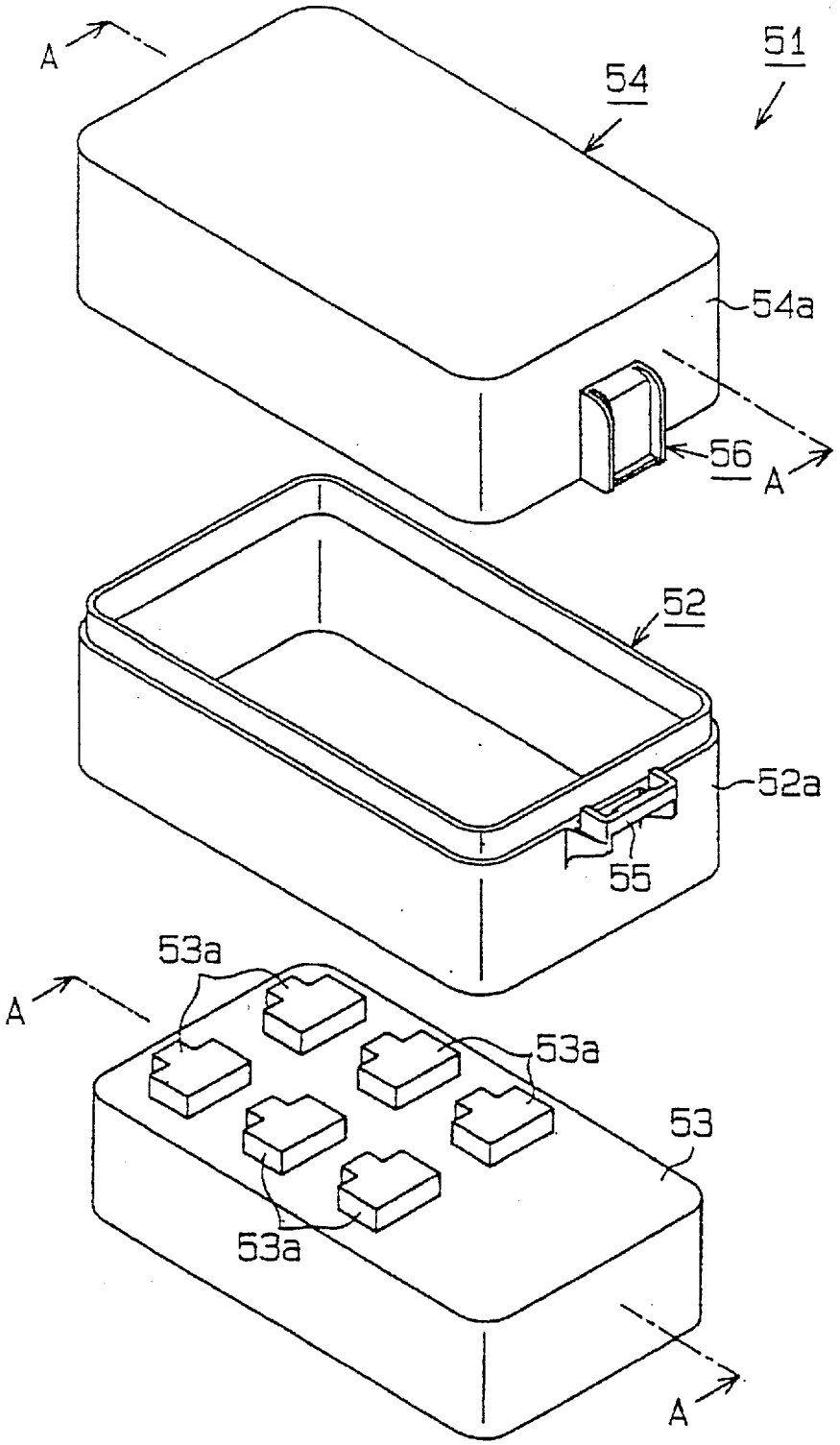
FIG.1 PRIOR ART
FIG. 1 is an exploded perspective view of a known electrical connector housing.
Figure 2:
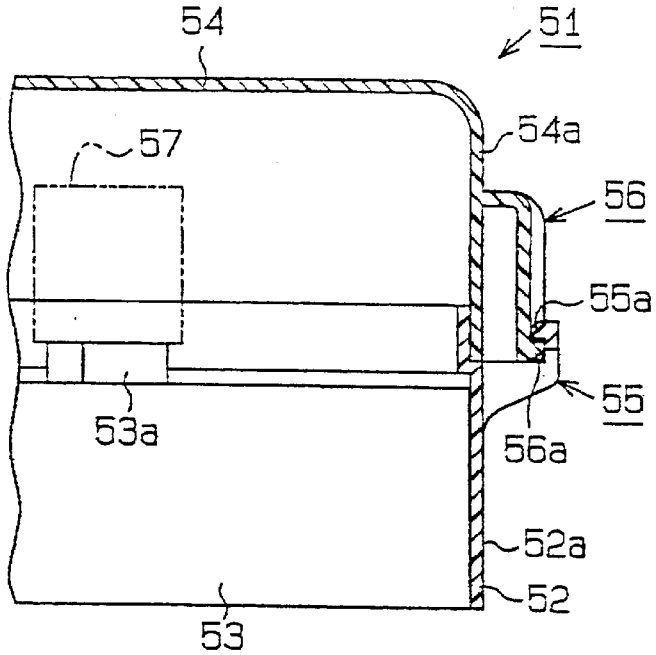
FIG.2 PRIOR ART
FIG. 2 is a cross-sectional view of the electrical connector housing of FIG. 1, taken along line A—A of FIG. 1.
Figure 3:
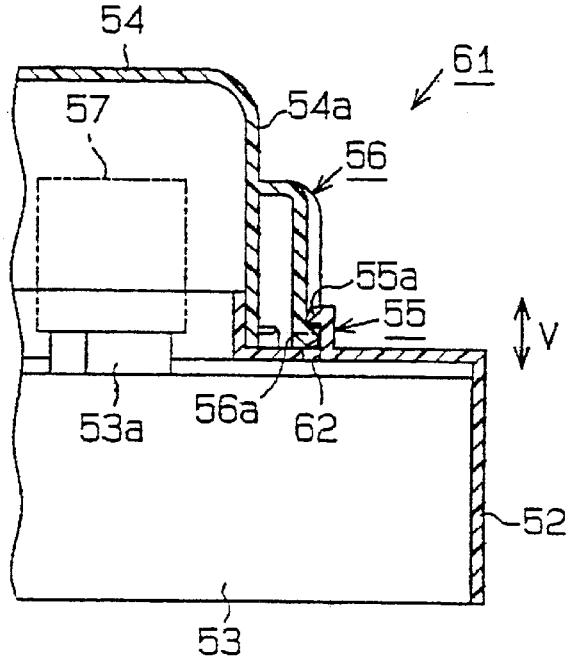
FIG.3 PRIOR ART
FIG. 3 is a cross-sectional view of another known electrical connector housing.
Figure 4:
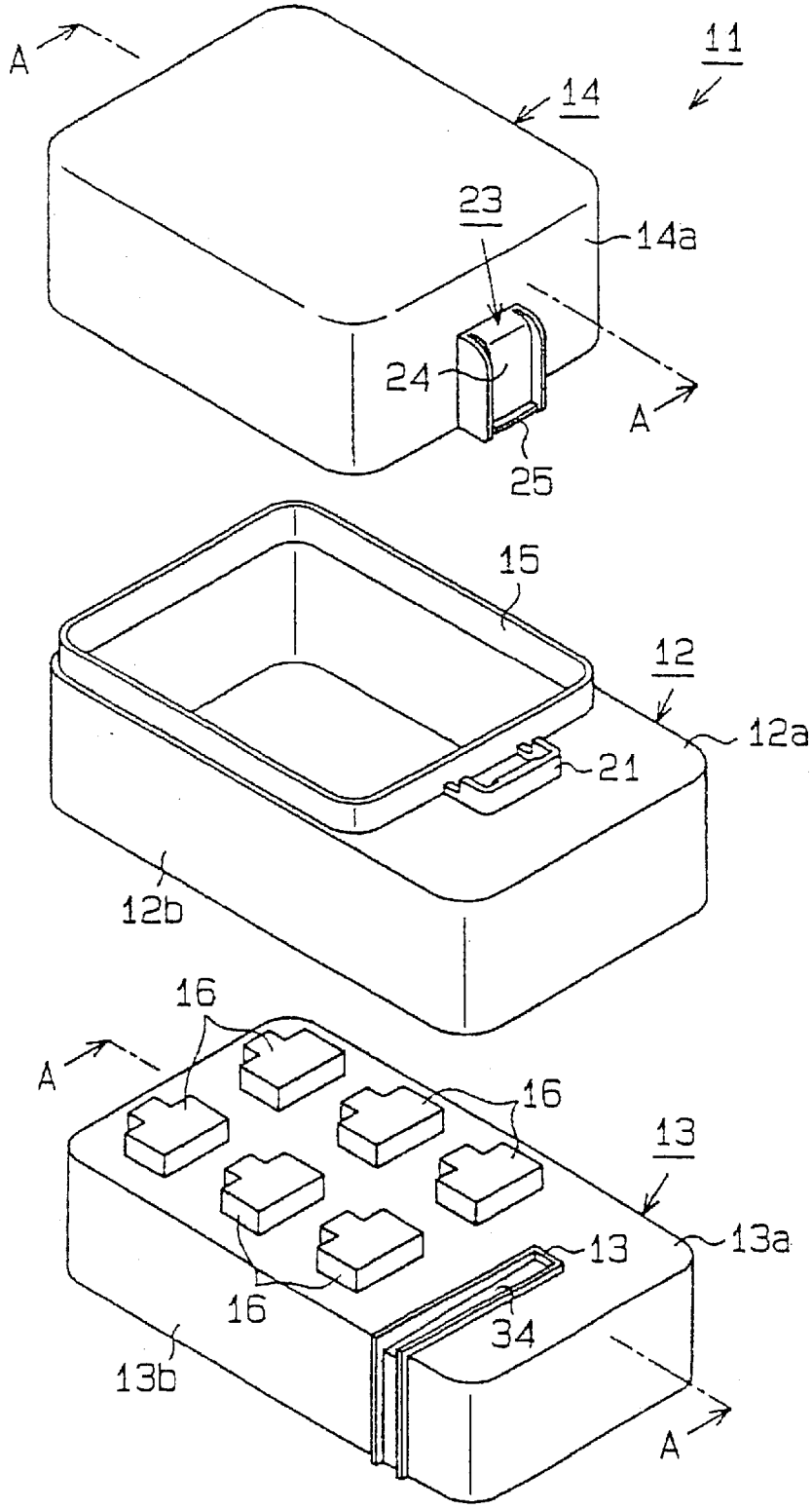
FIG. 4 is an exploded perspective view of an electrical connector housing according to a first embodiment of the present invention.

As shown in FIG. 4, an electrical connector housing 11 may include a lower shell 12, a connector block (or electrical-parts fixing block) 13 and an upper shell 14. The lower shell 12 has an open bottom and an upper panel 12*a* part of which forms an opening 15. The opening therefore has a surface smaller than that of the upper panel 12*a*. The lower shell 12 fixedly contains the connector block 13. The opening 15 is covered by the upper shell 14.

The connector block 13 has a substantially parallelepiped shape, and is formed so as to be contained in the lower shell 12. The upper surface 13*a* of the block 13 carries a plurality (six in the present case) of fixture ports 16 for electrical-parts, at given positions. The fixture ports 16 are positioned such that, when the connector block 13 is contained in the lower shell 12, the fixture posts are exposed to the outside through the opening 15 of the lower shell 12. In other words, the portion of upper surface 13*a* of the block 13 where fixture ports are not mounted is covered with the upper panel 12*a* of the lower shell 12. As shown by the broken lines in FIGS. 6 and 7, the fixture ports 16 are engageable with electrical apparatuses 17 such as relays and fusible links. The inside of the connector block 13 is wired with bus bars or the like (not shown in the figures). A desired circuitry can thus be formed by this wiring. Such a connector block 13 is fixed in the lower shell 12 by fixing mount devices (not shown in the figures).

Figure 5:
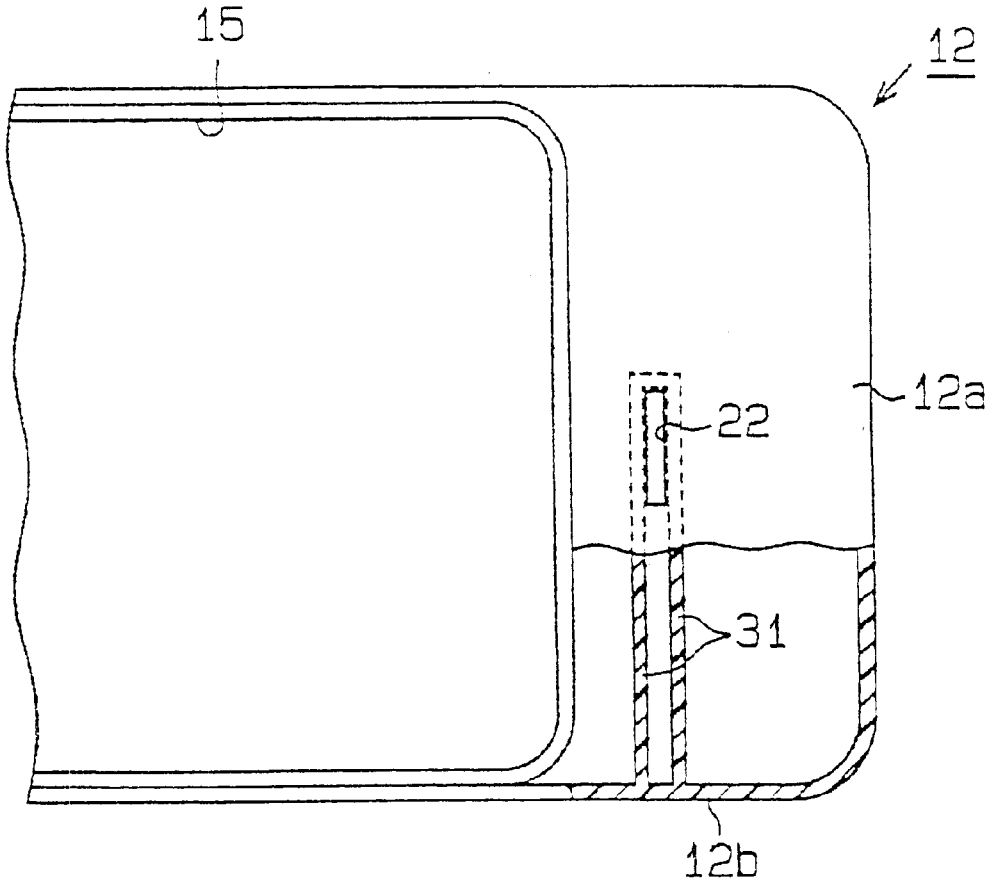
FIG. 5 is a top plan view of a lower shell, partly in cross-section, of an embodiment of the present invention.
Figure 6:
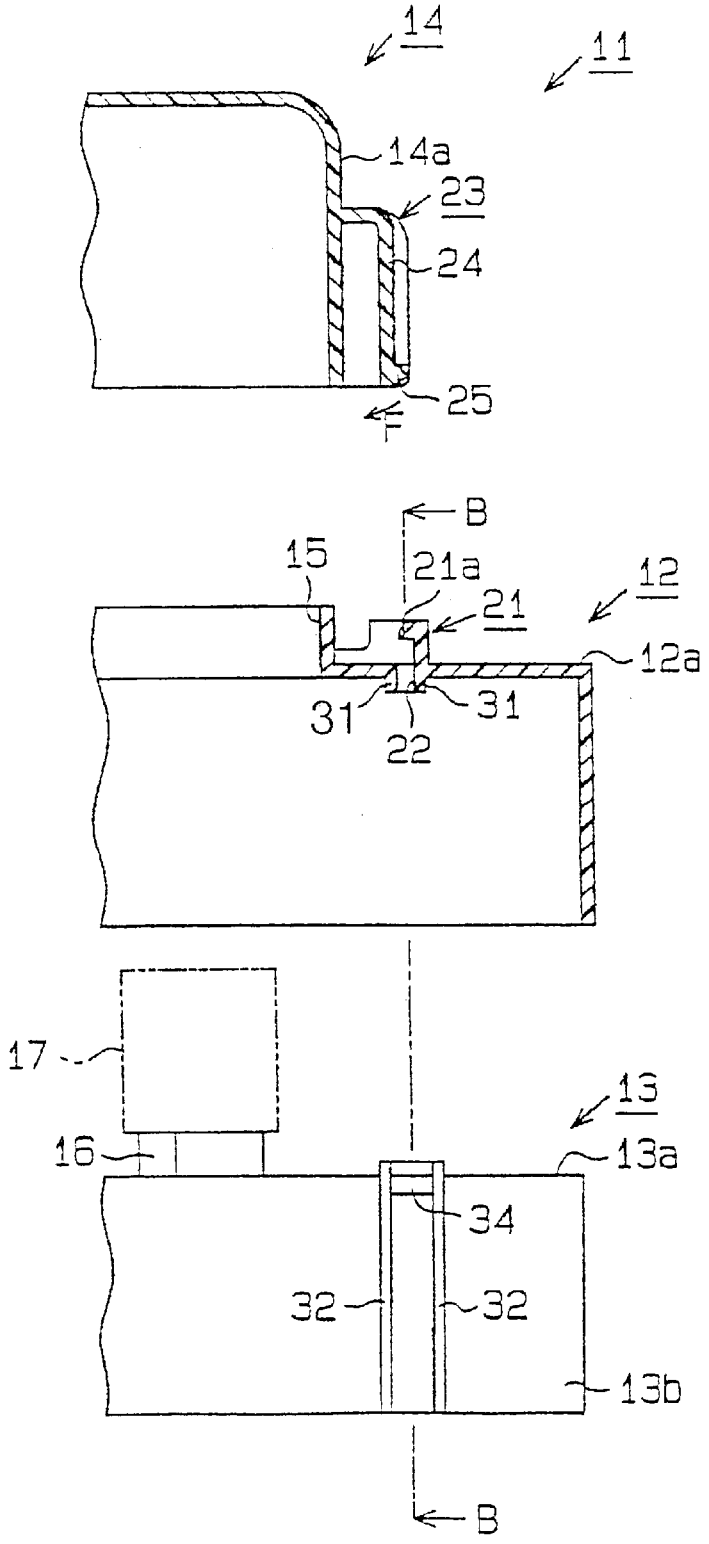
FIG. 6 is a partial cross-sectional view of the electrical connector housing of FIG. 4, taken along line A—A of FIG. 4.
Figure 7:
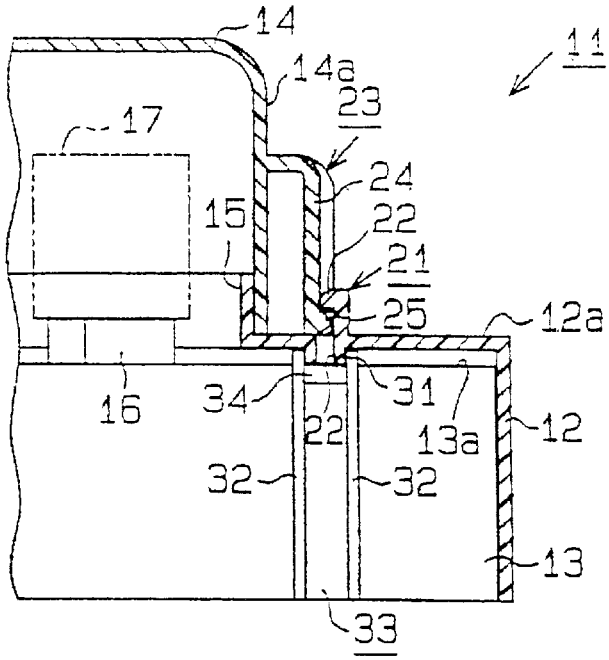
FIG. 7 is a partial cross-sectional view of the electrical connector housing of FIG. 4, when it is assembled and viewed along line A—A.
Figure 8:
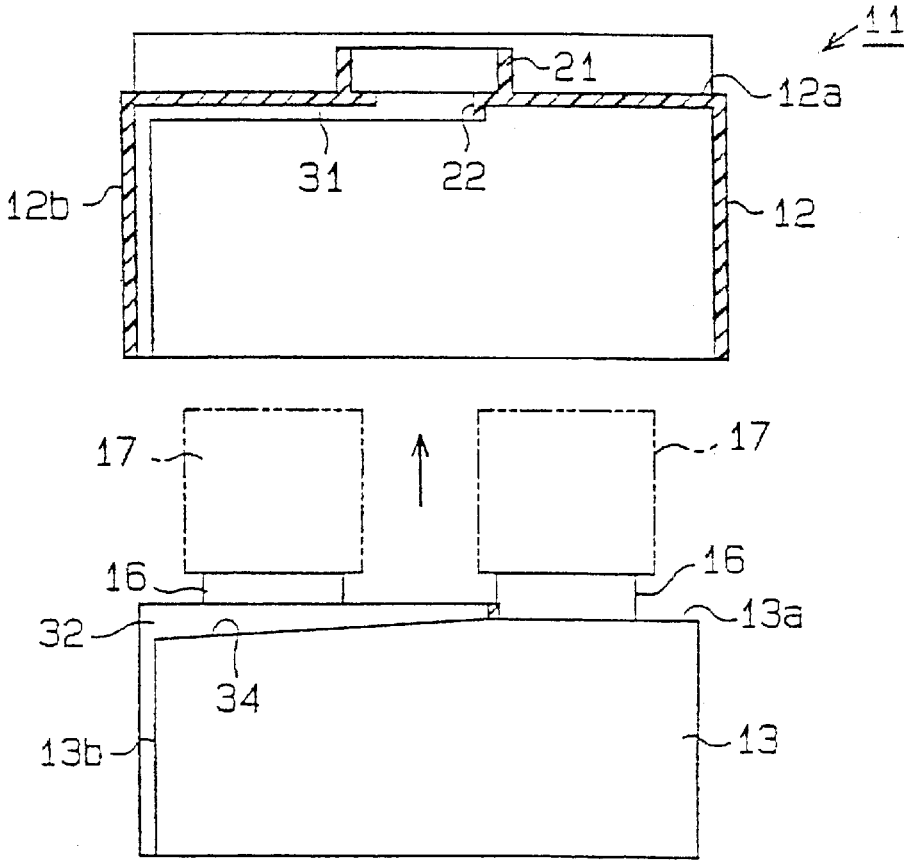
FIG. 8 is a partial cross-sectional view of the electrical connector housing of FIG. 6, when viewed along line B—B.

A first fixing mount 21 is formed near the opening 15 of the upper panel 12*a* of the lower shell 12, and holds the upper shell 14 in a freely engageable and removable way. As shown in FIGS. 6 and 7, the first fixing mount 21 includes a locking hook 21*a* which extends toward the opening 15. The upper panel 12*a* includes a draw hole 22 at a position just under the locking hook 21*a*. As shown in FIG. 5, this draw hole 22 has a rectangular shape, viewed from the above. The draw hole 22 has a hole size slightly greater than the size of the locking hook 21*a*.

The outer side face 14*a* of the upper shell 14 includes a second fixing mount 23 at a position corresponding to that of the first fixing mount 21 and is engageable therewith. The second fixing mount 23 includes a flexible fin 24 which can be deformed in a direction shown by arrow F in FIG. 6. The tip (facing downward) of the flexible fin 24 forms a hook portion 25 inclining towards the tip. The upper shell 14 can thus be fixed on the lower shell 12 by hooking the hook portion 25 on the locking hook 21*a*.

As shown in FIGS. 5 to 8, the inner face of the upper panel 12*a* is provided with a rib 31. The rib 31 extends toward a side panel 12*b* of the lower shell 12, so as to form a rectangular cross-section and surround three sides of the rectangular draw hole 22 (see FIG. 5), and further extends from the inner face of the upper panel 12*a* downwardly along the inner face of the side panel 12*b*.

The upper face 13*a* of the connector block 13 includes partition walls 32 at positions corresponding to the rectangular shape of the rib 31. These partition walls 32 are formed on the portion where the fixture ports 16 for the electrical parts are not located. As shown in FIG. 7, when the connector block 13 is mounted into the lower shell 12, the partition walls 32 closely flank the outer faces of the rib 31. To enable such a configuration, the partition walls 32 are formed so as to extend from the upper face 13*a* of the connector block 13 towards their side face 13*b*, and further downwardly along the side face 13*b*.

Accordingly, when the connector block 13 is contained in the lower shell 12, it is separated from the space for the fixture ports 16 by the rib 31 and the partition walls 32. At the same time, there is formed a draining space 33 which connects to the draw hole 22. Consequently, when water enters into the lower shell 12 of the electrical connector housing 11 via the draw hole 22, it can be drained away through the draining space 33.

Further, part of the upper face 13*a* of the connector block 13, geometrically corresponding to a position where the draining space 33 is installed, is inclined toward the side face 13*b* of the connector block 13, so as to form an inclined portion 34. Water penetrating into the electrical connector housing 11 thus runs downwardly toward the side face 13*b* of the connector block 13 along the inclined portion 34, and is drained out below the lower shell 12. Draining of the water is swift and efficient.

As a result, the present invention provides the following technical effects:

The first and the second fixing mounts 21 and 23 are contained within the area framework of the upper face of the lower shell 12, so that they do not extend beyond the lower and the upper shells 12 and 14. Thus, the size of the electrical connector housing 11 can thus be kept small.

Further, water entering into the electrical connector housing 11 via the draw hole 22 runs down through the draining space 33 formed by the rib 31 which is provided on the lower shell 12, and the partition walls 32 which are provided on the connector block 13. Moreover, the draining space 33 is separated from the space for fixture ports 16, so that water running down the draining space 33 cannot penetrate into the latter space. The electrical connector housing thus maintains a high waterproof quality.

Although the lower shell 12 includes a rib 31, it can be formed without using a complex die. Production costs of the electrical connector housing 11 can thus be kept to minimum.

Water entering into the draining space 33 via the draw hole 22 runs downwardly along the inclined portion 34 and is drained out beyond the side face 13*b* of the connector block 13. This draining is swift and efficient. Accordingly, the space for fixture ports 16 is efficiently protected from water penetration.

In the lower shell 12, the rib 31 extends from top of the inner face of shell's side panel 12*b* to the bottom thereof (not illustrated). In the connector block 13, the partition walls 32 extend from top of side face 13*b* to the bottom thereof. Accordingly, in the connector block 13, water enters the draining space 33 and runs down along the side face 13*b* of the block 13, and is then drained out below the block 13 and the lower shell 12. The space for the fixture ports 16 is thus positively protected from water penetration.

The rib 31 and the partition walls 32 are closely superposed, so that, even if water enters the draining space 33, it is nonetheless prevented from entering the space provided for the fixture ports 16.

The partition walls 32 are formed spaced from the fixture ports 16 for electrical-parts, so that the draining space 33 is also formed remotely from the fixture ports 16. The fixture ports 16 are thus more positively protected from water penetration.

Figure 9:
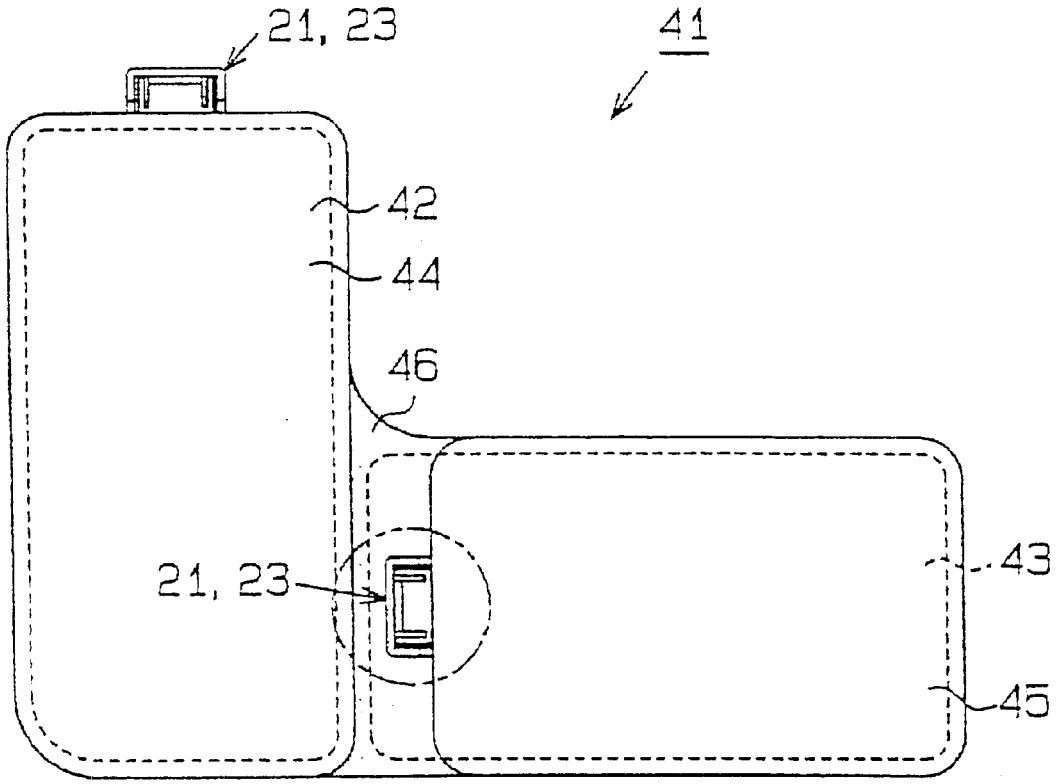
FIG. 9 is a top plan view of an electrical connector housing according to another embodiment of the present invention.

In another embodiment of the present invention, the shape of the electrical connector housing 11 can be modified as desired. As shown in FIG. 9, it can take substantially an L-shaped configuration (to include a second electrical connector housing 41). The second electrical connector housing 41 may separately contain two connector blocks 42 and 43, and two separate upper shells 44 and 45. The upper shells 44 and 45 are then separately mounted on the lower shell 46. As shown by broken lines in FIG. 9, a second fixing mount 23 and a corresponding first fixing mount 21 of a first upper shell 45 are positioned on the lower shell 46. As these fixing mounts 21 and 23 do not extend beyond the surface framework of the electrical connector housing 41, the size thereof is not enlarged. Further, by dividing the upper shell into two parts 44 and 45, the unit maintenance efficiency for electrical connector housings can be improved.

Alternatively, the rib 31 formed on the inner face of the side panel 12*b* of lower shell 12, as well as the partition walls 32 formed on the side face 13*b* of the connector block 13 may be omitted. The form of the lower shell 12 and the connector block 13 can thus be simplified.

Alternatively yet, the inclined portion 34 may be eliminated and made flat. Even then, the electrical-parts fixture sites 16 may be protected against water penetration.

Such electrical connector housings 11 may be mounted not only in automobiles or wagons, but also in industrial machinery.

Beside what has been described above, the electrical connector housings according to the present invention provide the following technical features and advantages.

The partition walls described above are formed farther from the electrical-parts fixture ports 16. Accordingly, even if water penetrates into the electrical connector housing 11, the water is still prevented from reaching the fixture ports 16.

Typically, the electrical connector housing of the invention is mounted in automobiles or vehicles, more specifically in engine compartments of such vehicles.

By virtue of the above configuration, the size of the electrical connector housing can be kept as small as possible, while the production costs thereof can be maintained as low as possible. Moreover, the waterproof quality of the electrical connector housing is improved.

Furthermore, water penetration into the space for the electrical-parts fixture ports is positively prevented.

Although the invention has been described with reference to particular means, materials and embodiments, it is to be understood that the invention is not limited to the particulars disclosed and extends to all equivalents within the scope of the claims.

The present disclosure relates to subject matter contained in priority Japanese Application No. HEI 11-343643, filed on Dec. 2, 1999, which is herein expressly incorporated by reference in its entirety.

What is claimed:

1. An electrical connector housing comprising a lower shell including an upper panel with at least one opening and a side panel, at least one connector block including fixture ports provided thereon and being contained in said lower shell, and at least one upper shell covering said at least one opening of said upper panel;

said upper panel of said lower shell including at least one first fixing mount with a locking hook and at least one draw hole both positioned outside said at least one opening, said at least one upper shell comprising an outer side face including at least one second fixing mount, such that said at least one draw hole is usable for forming said locking hook and such that said at least one second fixing mount is freely engageable with, and removable from, said first fixing mount;

said upper panel of said lower shell having an inner face comprising at least one rib which is placed near said at least one draw hole and extends towards said side panel of said lower shell while surrounding said at least one draw hole, said upper face of said at least one connector block comprising a pair of partition walls at a position corresponding to that of said at least one rib, so that, when said at least one connector block is inserted into said lower shell, said at least one rib is interposed between said partition walls, thereby forming a draining space remote from a space for said fixture ports.

2. The electrical connector housing according to claim 1, wherein said electrical connector housing comprises said lower shell formed substantially in an L-shape, when viewed from the above, and includes said upper panel with two openings, said electrical connector housing further comprises two separate connector blocks and two separate corresponding upper shells, and at least one of said two openings, two connector blocks and two upper shells include a corresponding draw hole and first and second fixing mounts.

3. The electrical connector housing according to claim 1, wherein said at least one rib further extends from top to bottom on an inner face of said side panel in said lower shell, and said pair of partition walls further extends from top to bottom on said side face of said connector block.

4. The electrical connector housing according to claim 2, wherein said at least one rib further extends from top to bottom on an inner face of said side panel in said lower shell, and said pair of partition walls further extends from top to bottom on said side face of said connector block.

5. The electrical connector housing according to claim 1, wherein said upper face of said connector block has an enclosed portion between said partition walls and said enclosed portion includes a portion inclining towards said side face of said connector block.

6. The electrical connector housing according to claim 2, wherein said upper face of said connector block has an enclosed portion between said partition walls and said enclosed portion includes a portion inclining towards said side face of said connector block.

7. The electrical connector housing according to claim 3, wherein said upper face of said connector block has an enclosed portion between said partition walls and said enclosed portion includes a portion inclining towards said side face of said connector block.

8. The electrical connector housing according to claim 4, wherein said upper face of said connector block has an enclosed portion between said partition walls and said enclosed portion includes a portion inclining toward said side face of said connector block.

9. An electrical connector housing comprising a lower shell including an upper panel with at least one opening and a side panel, at least one connector block including fixture ports provided thereon and being contained in said lower shell, and at least one upper shell covering said at least one opening of said upper panel;

said upper panel of said lower shell including at least one first fixing mount with a locking hook and at least one draw hole both positioned outside said at least one opening, said at least one upper shell comprising an outer side face including at least one second fixing mount, such that said at least one draw hole is usable for forming said locking hook and such that said at least one second fixing mount is freely engageable with, and removable from, said first fixing mount; and at least one drain including a drain portion formed separately from said lower shell and disposed below said at least one draw hole, said drain portion interfitting with a projecting portion of said lower shell and extending toward and downwardly along said side panel of said lower shell.

10. The electrical connector housing according to claim 9, wherein said projecting portion of said lower shell comprises at least one rib on said upper panel of said lower shell and said drain portion comprises a pair of partition walls on said at least one connector block at a position corresponding to that of said at least one rib, so that, when said at least one connector block is inserted into said lower shell, said at least one rib is interposed between said partition walls, thereby forming said drain at a position remote from a space for said fixture ports.

11. The electrical connector housing according to claim 9, wherein said electrical connector housing comprises said lower shell formed substantially in an L-shape, when viewed from the above, and includes said upper panel with two openings, said electrical connector housing further comprises two separate connector blocks and two separate corresponding upper shells, and at least one of said two openings, two connector blocks and two upper shells include a corresponding draw hole and first and second fixing mounts.

12. The electrical connector housing according to claim 9, wherein said upper face of said connector block has an enclosed portion between said partition walls and said enclosed portion includes a portion inclining towards said side face of said connector block.

* * * * *